US010220531B2

(12) United States Patent
Millis

(10) Patent No.: US 10,220,531 B2
(45) Date of Patent: Mar. 5, 2019

(54) TRIMMING PROFILE AND ELECTRIC CLIPPERS GUIDE ATTACHMENT FOR TRIMMING HAIR AROUND THE HUMAN EAR

(71) Applicant: Van A. Millis, Denver, CO (US)

(72) Inventor: Van A. Millis, Denver, CO (US)

( * ) Notice: Subject to any disclaimer, the term of this patent is extended or adjusted under 35 U.S.C. 154(b) by 0 days.

(21) Appl. No.: 15/646,321

(22) Filed: Jul. 11, 2017

(65) Prior Publication Data

US 2018/0222067 A1 Aug. 9, 2018

Related U.S. Application Data

(60) Provisional application No. 62/455,032, filed on Feb. 6, 2017.

(51) Int. Cl.

| | |
|---|---|
| ***B26B 19/38*** | (2006.01) |
| ***B26B 19/06*** | (2006.01) |
| ***B26B 19/20*** | (2006.01) |

(52) U.S. Cl.

CPC ..... *B26B 19/3813* (2013.01); *B26B 19/06* (2013.01); *B26B 19/20* (2013.01); *B26B 19/3826* (2013.01)

(58) Field of Classification Search

CPC . B26B 19/3813; B26B 19/3806; B26B 13/24; B26B 19/06; B26B 19/20; B26B 19/3826; A45D 24/36

USPC ..... 132/214

See application file for complete search history.

(56) References Cited

U.S. PATENT DOCUMENTS

| | | | | |
|---|---|---|---|---|
| 2,749,922 A | | 6/1956 | Daniel et al. | |
| 3,008,233 A | * | 11/1961 | Waggoner | B26B 19/20 30/537 |
| 3,407,823 A | * | 10/1968 | Selvaggio | A45D 24/36 132/214 |
| 3,709,234 A | * | 1/1973 | Seerahn | A45D 24/36 132/214 |
| 4,724,614 A | * | 2/1988 | Wahl | B26B 19/22 30/200 |
| 5,012,830 A | * | 5/1991 | Vaccaro | A45D 24/36 132/124 |
| 6,267,119 B1 | * | 7/2001 | Silva | A45D 8/30 132/213 |
| 7,073,517 B1 | * | 7/2006 | Burnette, III | A45D 24/06 132/144 |
| 8,826,922 B1 | * | 9/2014 | Lewis | A45D 24/36 132/213 |

(Continued)

FOREIGN PATENT DOCUMENTS

| | | | |
|---|---|---|---|
| FR | 619 429 | * | 4/1927 |
| FR | 2 666 207 | * | 3/1992 |

*Primary Examiner* — Hwei-Siu C Payer

(74) *Attorney, Agent, or Firm* — Macheledt Bales LLP; Jennifer L. Bales

(57) ABSTRACT

A curved trimming profile shaped to border a portion of the ear forms a channel for an electric clippers attachment to follow and trim hair around the ear. The trimming profile has two portions that clamp over the hair. Each portion has a track, and the tracks form the profile channel when the portions are clamped together. Teeth between the portions hold the hair in place. The attachment has a channel guide for engaging with the profile channel and a groove which allows clipper blades to trim hair as the clippers travel. The rest of the clipper blades are blocked by the attachment.

14 Claims, 2 Drawing Sheets

(56) References Cited

U.S. PATENT DOCUMENTS

| | | | | |
|---|---|---|---|---|
| 9,168,661 | B1 * | 10/2015 | Ho | B26B 13/10 |
| 9,289,906 | B2 * | 3/2016 | Croft | B26B 15/00 |
| 2004/0250429 | A1 * | 12/2004 | McCambridge | B26B 19/20 30/233.5 |
| 2010/0275944 | A1 * | 11/2010 | Bandonis | A45D 8/30 132/200 |
| 2018/0222067 | A1 * | 8/2018 | Millis | B26B 19/3813 |

* cited by examiner

TRIMMING PROFILE AND ELECTRIC CLIPPERS GUIDE ATTACHMENT FOR TRIMMING HAIR AROUND THE HUMAN EAR

BACKGROUND OF THE INVENTION

Field of Invention

The present invention relates to apparatus for trimming hair around a human ear including a trimming profile element and an electric clippers attachment.

Description of Related Art

Haircuts are a significant component of the average person's budget. The more haircuts an individual needs in any given year, the greater the total expense. A few weeks after a haircut, men typically see the hair above their ear grow to the point it touches or hangs over the auricle. This occurrence is usually perceived as unsightly and creates the need to incur the expense of a new haircut despite the fact the rest of the individual's hair is at an acceptable length and not necessarily in need of a haircut for several weeks or more. A need exists for the average person to be able to reduce the number of needed haircuts by cheaply and professionally trimming this excess hair in a do-it-yourself manner.

A need remains in the art for apparatus to enable its user to trim the hair above the ear into a smooth and tidy curve.

SUMMARY OF THE INVENTION

It is an object of the present invention to enable the user to trim the hair above the ear into a smooth and tidy curve. The apparatus includes a trimming profile element sized and shaped to curve around a human ear, and an attachment for electric clippers. The trimming profile could be rigid or malleable to allow the user a customized curve. The trimming profile has an outer portion and an inner portion and includes teeth for catching and holding the hair to be trimmed between the outer portion and the inner portion. It also includes a profile channel for guiding the clippers via the clippers attachment. The clippers attachment includes guide elements which engage with the profile channel to guide the clippers and prevent hair that is not intended to be cut from exposure to the clipper blades.

The trimming profile generally includes a catch to hold the outer portion and the inner portion clamped onto the hair to be trimmed. It may include two profile channels, one on either side of the teeth, so the same guide can be used for both ears.

For large clippers, the clipper attachment blocks most of the clipper teeth, but includes a channel guide groove within the channel guide which allows a small portion of the clipper teeth to emerge and clip the hair around the ear. The same concept applies to smaller hair grooming devices such as nose trimmers but the clipper attachment may not need to block most or any of the clipper teeth.

Apparatus for trimming hair around a human ear comprises a curved trimming profile shaped to border a portion of the ear and having a pair of matched, curved trimming profile portions configured to clamp together on the hair such that an inside edge of each portion faces the inside edge of the other portion, a set of teeth disposed on the inside edge of a profile configured to hold the hair in place, and a track along the inside edge of each portion, the tracks forming a first profile channel.

Also included is an electric clippers attachment configured to fit over a head of an electric hair clippers and having a guard configured to allow access to at least a portion of the clipper blades, with a channel guide formed in the guard and configured to engage with the first profile channel. In use, the attachment channel guide moves within the first profile channel and the accessible clipper blades trim hair along the first profile channel.

In some embodiments, the guard covers most of the clipper blades and the channel guide includes a groove configured to expose the accessible clipper blades. In a preferred embodiment, the channel guide includes two L-shaped protrusions extending away from each other and the tracks include two protrusions extending toward each other to partially surround the L-shaped channel guide protrusions when the channel guide is engaged with the first profile channel.

The profile teeth may be disposed along the inside edge of each portion so the teeth interlace. The profile may further include a second profile channel formed across the teeth from the first profile channel to allow the same profile to be used for both ears.

The attachment channel guide then moves within the second profile channel and again the accessible blades trim hair along the second profile channel.

The trimming profile may include a hinge and a locking device configured to secure the portions in a clamped position. It may be formed of a material that is rigid or malleable.

DETAILED DESCRIPTION OF THE PREFERRED EMBODIMENT

Table 1 shows the elements of the present invention along with their associated reference numbers.

TABLE 1

| Reference No. | Element |
|---|---|
| 100 | Trimming profile |
| 102 | Trimming profile teeth |
| 104 | Trimming profile hinge |
| 106 | Trimming profile outer curved portion |
| 108 | Trimming profile inner curved portion |
| 300 | Trimming profile channel |
| 302 | Outer profile portion track |
| 304 | Inner profile portion track |
| 402 | Trimming profile locking device |
| 404 | Locking device hinge |
| 600 | Electric clippers head |
| 602 | Clippers blades |
| 800 | Clipper guide attachment |
| 802 | Channel guide |
| 804 | Channel guide outer portion |
| 806 | Channel guide inner portion |
| 808 | Channel guide groove |
| 810 | Exposed blade portion |

Figure 1:
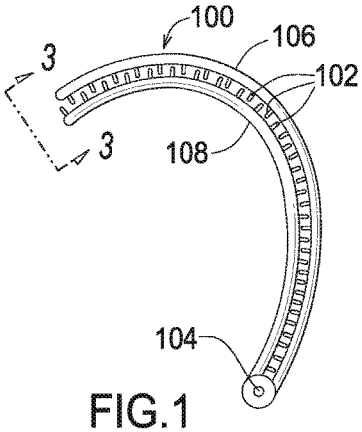
FIG. 1 shows a side view of the trimming profile in the closed position.

FIG. 1 shows a side view of trimming profile 100 in the closed position. Trimming profile 100 is shaped to match the outer curve of the ear (not shown) and clamps hair to be trimmed (not shown) in place. Trimming profile 100 includes an outer curved profile portion 106 and an inner curved profile portion 108, connected at hinge 104. Profile outer portion 106 and profile inner portion 108 include teeth 102 which interlace when portions 106, 108 are engaged. Teeth 102 hold the hair in place.

FIG. 1 shows trimming profile 100 as it would be seen by the user. Its curve does not necessarily represent the myriad curves the electric clippers attachment can take. This represents how it would roughly line up with the auricle to provide a smooth curve for the electric clipper to follow. The shape of the invention results in a clean cut line around the ear eliminating the excess hair growth. Profile 100 could be formed of various materials, for example rigid or slightly flexible plastic.

Figure 2:
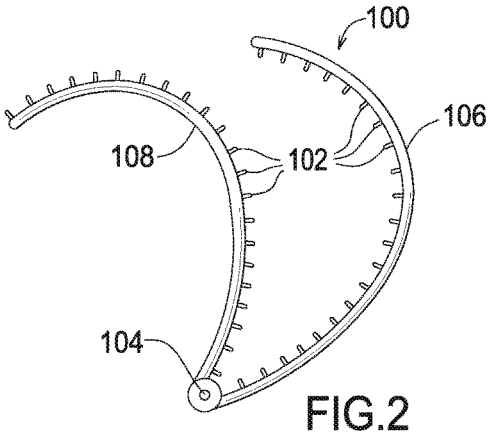
FIG. 2 shows a side view of the trimming profile in the open position.

FIG. 2 shows a side view of trimming profile 100 in an open position. Outer curved profile portion 106 and inner curved profile portion 108 have been rotated apart about hinge 104. The user tucks hair to be trimmed between profile portions 106, 108 and rotates them back together to hold the hair in place. This clamps the excess and unwanted hair between profile portions 106, 108. Teeth 102 are comb-like structures that will reinforce the clamping to secure the hair in place.

Figure 3:
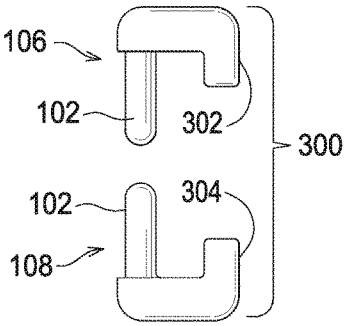
FIG. 3 is a magnified cutaway view of the trimming profile channel that provides a guide for the electric clipper.
Figure 9:
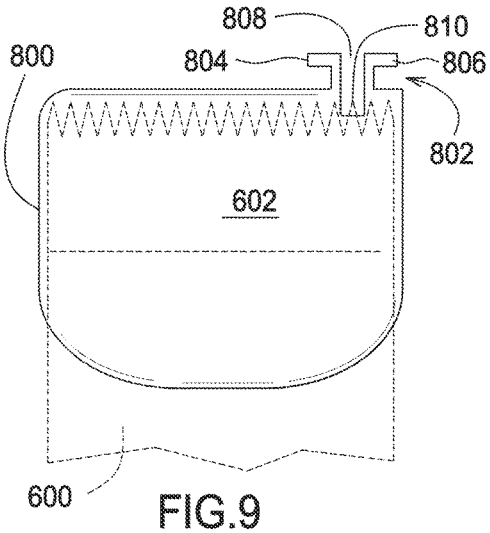
FIG. 9 shows a front view of an electric clippers attachment according to the present invention, fitted onto the clippers head of FIGS. 7 and 8.
Figure 10:
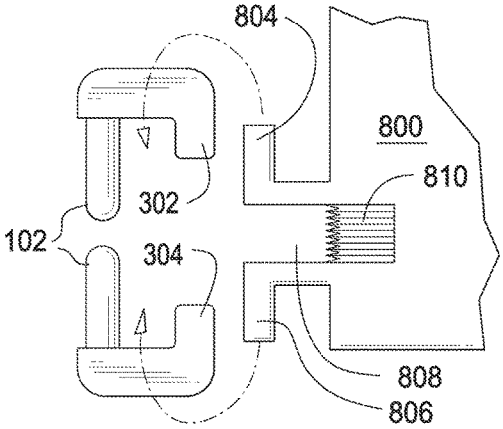
FIG. 10 is a magnified front cutaway view showing the channel guide of the clippers attachment of FIG. 9 engaged with the profile channel of the trimming profile element shown in FIGS. 1-6.

FIG. 3 is a magnified cutaway view of trimming profile 100 profile channel 300 that will provide a guide for the electric clipper as shown in FIGS. 9 and 10. Profile channel 300 comprises an outer profile portion track 302 on profile outer portion 106 and an inner profile portion track 304 on profile inner portion 108. Tracks 302, 304 form profile channel 300 when portions 106, 108 are clamped together. Profile channel 300 is opposite teeth 102. Thus hair clamped between profile portions 106, 108 is held in place by teeth 102 and extends into and possibly beyond profile channel 300. Only this hair will be trimmed.

Figure 4:
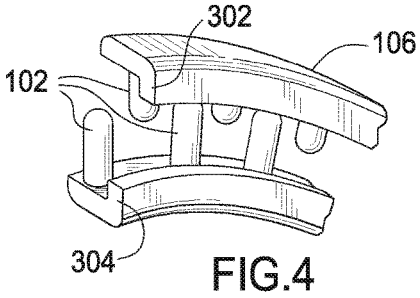
FIG. 4 is a magnified isometric view of a portion of the trimming profile showing teeth and the profile channel.

FIG. 4 is a magnified isometric view of a portion of trimming profile 100 showing teeth 102 and profile channel 300. Teeth 102 extending from profile inner portion 108 are interspersed with teeth 102 extending from profile outer portion 106.

Figure 5:
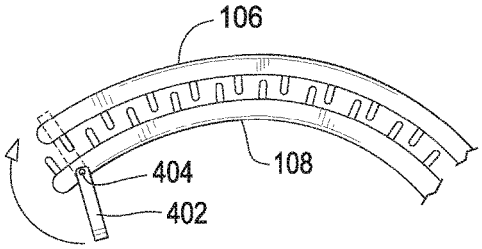
FIG. 5 is a side view of a portion of the trimming profile showing a small locking device that secures the inner and outer curved portions of the trimming profile in place.

FIG. 5 is a side view of a portion of trimming profile 100 showing a small locking device 402 that secures inner and outer profile portions 108, 106 of trimming profile 100 in place. When inner and outer profile portions 108, 106 are engaged as shown in FIG. 5, locking device 402 pivots around locking device hinge 404 on inner profile portion 108 and catches on the end of outer profile portion 106 (see dotted lines). Those skilled in the art will appreciate that locking device hinge 404 could alternatively be disposed on outer profile portion 106 or various other locking methods could be used.

Figure 6:
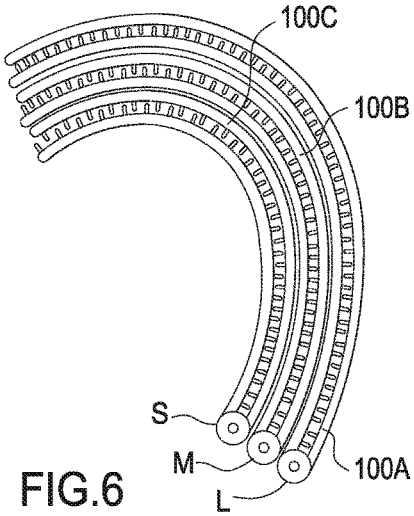
FIG. 6 shows a side view of three concentric sizes of the invention.

FIG. 6 shows a side view of three concentric sizes of trimming profile 100 which could be made available to consumers to provide options to fit the user's ear size. The concentric sizing also promotes compact packaging and portability. The invention could alternatively be designed in a single profile with multiple curves, along the principle of a French curve, to provide the user with versatility. A malleable curve design could also be used to provide the user with a more customizable curve.

Figure 7:
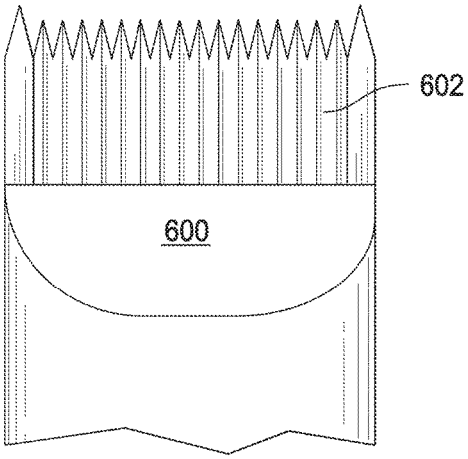
FIG.7 (Prior Art)
FIG. 7 (prior art) shows a front view of a conventional handheld clippers head.
Figure 8:
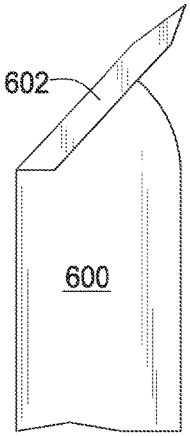
FIG.8 (Prior Art)
FIG. 8 (Prior art) is a side view of the clippers head of FIG. 7.

FIG. 7 (prior art) shows a front view of conventional handheld electric clippers head 600, including clippers blades 602. FIG. 8 (Prior art) is a side view of the clippers head 600. In use, clippers blades 602 slide in an oscillating manner to trim hair that passes between two blades 602.

FIG. 9 shows a front view of clipper guide attachment 800, fitted onto clippers head 600 (dotted lines). In a preferred embodiment, attachment 800 is formed of a rigid plastic and snaps onto head 600, similar to existing clipper attachments.

Clipper guide attachment 800 of FIG. 9 covers all but a small section 810 of clipper blades 602, as only a small width of hair needs to be removed (i.e. the hair that is clamped and held between inner and outer profile portions 108, 106 and extending into profile channel 300). Clipper guide attachment 800 forms a channel guide groove 808 to allow an exposed blade portion 810 to clip the clamped hair. Clipper guide attachment 800 forms a channel guide 802 which fits into profile channel 300 as shown in FIG. 10. Channel guide 802 comprises a channel guide outer portion 804 and a channel guide inner portion 806 on either side of channel guide groove 808. In the embodiment of FIG. 9, portions 804 and 806 are L shaped and extend away from each other. In this case, tracks 302, 304 extend towards each other and partially surround portions 804, 806 when profile channel 300 is engaged with channel guide 802. Various other configurations could be used to guide clippers head 600 along trimming profile 100.

Clipper guide attachment 800 can be retrofitted to fit existing electric clippers, both larger sizes as depicted in FIGS. 7-9 as well as smaller trimmers that are designed for removing nose hair, inner ear hair, mustache and facial hair trimmers, etc.

FIG. 10 is a magnified front cutaway view showing channel guide 802 of clipper guide attachment 800 engaged with profile channel 300 of trimming profile 100. In the embodiment of FIG. 10, clipper head 600 travels along a curved path delineated by trimming profile 100 as channel guide 802 slides along within profile channel 300. Exposed blade portion 810 trims the hair the user clamped into trimming profile 100.

Figure 11:
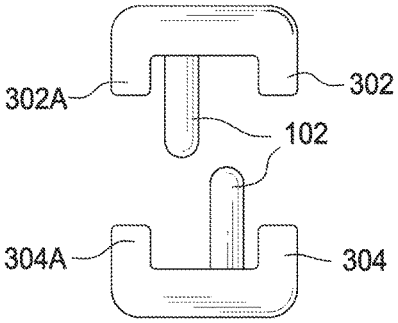
FIG. 11 is a magnified cutaway view of a second embodiment of the trimming profile having profile channels on either side of the profile teeth.

FIG. 11 is a magnified cutaway view of a second embodiment of a trimming profile 100 having two profile channels disposed on either side of teeth 102. A first channel 300 is formed by tracks 302 and 304 and a second channel 300 is formed by tracks 302A and 304A. Tracks 300, are formed on either side of teeth 102. This embodiment is useful because it allows the same trimming profile 100 to be used on each of the user's ears.

Note that terms such as inner and outer are used for convenience in understanding the figures, and those skilled in the art will appreciate that orientations and configurations can change or be exchanged within the spirit of the invention. For example, the attachment channel guide could be configured to partially surround and move outside of the profile channel rather than moving within it.

What is claimed is:

1. An apparatus for facilitating trimming hair around a human ear comprising:

a curved trimming profile shaped to border a portion of the ear and having — a pair of matched, curved trimming profile portions configured to clamp together on the hair such that an inside edge of one of the profile portions faces the inside edge of the other of the profile portions, a set of teeth disposed on the inside edge of the one of the profile portions configured to hold the hair in place, and a track along the inside edge of each of the profile portions, the tracks forming a first profile channel; and an electric clippers attachment configured to fit over a head of an electric hair clippers, the hair clippers head having clipper blades, and the attachment having — a guard configured to allow access to at least a portion of the clipper blades, and a channel guide formed in the guard, the channel guide configured to engage with the first profile channel;

wherein the channel guide engages with and moves along the first profile channel and the accessible portion of the clipper blades trims hair along the first profile channel.

2. The apparatus of claim 1 wherein the guard is further configured to cover most of the clipper blades and wherein the channel guide includes a groove configured to expose the accessible portion of the clipper blades.

3. The apparatus of claim 2 wherein the channel guide includes two L-shaped protrusions extending away from each other and the tracks include two protrusions extending toward each other and configured to partially surround the L-shaped protrusions when the channel guide is engaged with the first profile channel.

4. The apparatus of claim 2 wherein the teeth are disposed along the inside edge of each profile portion and the teeth interlace.

5. The apparatus of claim 4, further including a second profile channel formed across the teeth from the first profile channel and wherein the channel guide moves along the second profile channel and the accessible portion of the clipper blades trims hair along the second profile channel.

6. The apparatus of claim 2, further including a second profile channel formed across the teeth from the first profile channel and wherein the channel guide moves along the second profile channel and the accessible portion of the clipper blades trims hair along the second profile channel.

7. The apparatus of claim 1 wherein the trimming profile further includes a hinge and a locking device configured to secure the profile portions in a clamped position.

8. The apparatus of claim 1 wherein the trimming profile is rigid.

9. The apparatus of claim 1 wherein the trimming profile is malleable.

10. The apparatus of claim 1 wherein the channel guide includes two L-shaped protrusions extending away from each other and the tracks include two protrusions extending toward each other and configured to partially surround the L-shaped protrusions when the channel guide is engaged with the first profile channel.

11. The apparatus of claim 1 wherein the teeth are disposed along the inside edge of each profile portion and the teeth interlace.

12. The apparatus of claim 1, further including a second profile channel formed across the teeth from the first profile channel and wherein the channel guide moves within the second profile channel and the accessible portion of the clipper blades trims hair along the second profile channel.

13. The apparatus of claim 12 wherein the channel guide includes two L-shaped protrusions extending away from each other and the tracks include two protrusions extending toward each other and configured to partially surround the L-shaped protrusions when the channel guide is engaged with the first profile channel.

14. The apparatus of claim 13 wherein the teeth are disposed along the inside edge of each said profile portion and the teeth interlace.

* * * * *